US009611678B2

(12) United States Patent
Weinerman et al.

(10) Patent No.: US 9,611,678 B2
(45) Date of Patent: Apr. 4, 2017

(54) LATCH ASSEMBLY

(71) Applicant: The Eastern Company, Cleveland, OH (US)

(72) Inventors: Lee S. Weinerman, Medina, OH (US); Scott Arthurs, Brunswick, OH (US)

(73) Assignee: THE EASTERN COMPANY, Cleveland, OH (US)

( * ) Notice: Subject to any disclaimer, the term of this patent is extended or adjusted under 35 U.S.C. 154(b) by 111 days.

(21) Appl. No.: 14/744,184

(22) Filed: Jun. 19, 2015

(65) Prior Publication Data

US 2015/0376922 A1 Dec. 31, 2015

Related U.S. Application Data

(60) Provisional application No. 62/018,131, filed on Jun. 27, 2014.

(51) Int. Cl.

| | |
|---|---|
| ***E05C 3/24*** | (2006.01) |
| ***E05B 41/00*** | (2006.01) |
| ***E05B 5/00*** | (2006.01) |
| ***E05B 13/00*** | (2006.01) |

(52) U.S. Cl.

CPC ..... *E05C 3/24* (2013.01); *E05B 5/00* (2013.01); *E05B 13/005* (2013.01); *E05B 41/00* (2013.01)

(58) Field of Classification Search

CPC ..... E05B 13/002; E05B 13/005; E05B 5/00; E05B 41/00; E05B 7/00; E05B 83/16; E05B 83/24; E05C 3/24; E05C 19/145; E05C 1/065

USPC ..... 70/208, 210; 292/DIG. 31, 216, 336.3

See application file for complete search history.

(56) References Cited

U.S. PATENT DOCUMENTS

| | | | | |
|---|---|---|---|---|
| 5,046,340 | A * | 9/1991 | Weinerman | E05B 9/08 292/227 |
| 5,299,844 | A * | 4/1994 | Gleason | E05B 17/002 292/240 |
| 5,586,458 | A * | 12/1996 | Weinerman | E05B 5/00 292/240 |
| 5,884,948 | A | 3/1999 | Weinerman et al. | |
| 5,941,104 | A * | 8/1999 | Sadler | E05B 85/14 292/216 |

(Continued)

OTHER PUBLICATIONS

International Search Report and the Written Opinion of the International Searching Authority, Jun. 23, 2015, PCT/US2015/037219, Applicant the Eastern Company.

*Primary Examiner* — Suzanne Barrett

(74) *Attorney, Agent, or Firm* — Ralph E. Jocke; Walker & Jocke

(57) ABSTRACT

A latch assembly is provided that includes a housing, a release mechanism and a latch mechanism. The release mechanism includes a handle. Movement of the handle from a retracted position towards an extended position relative to the housing is operable to cause the latch mechanism to change from a latched condition to an unlatched condition. When the latch mechanism changes from an unlatched condition to the latched condition, the latch mechanism is operable to cause the release mechanism to cause the handle to move to the retracted position. When the latch mechanism is in the unlatched condition, the latch mechanism maintains the release mechanism in a configuration that maintains the handle away from the retracted position and provides a visual indication that the latch mechanism is in the unlatched condition.

18 Claims, 10 Drawing Sheets

(56) References Cited

U.S. PATENT DOCUMENTS

| | | | | |
|---|---|---|---|---|
| 6,513,353 | B1 | 2/2003 | Weinerman et al. | |
| 6,651,467 | B1 | 11/2003 | Weinerman et al. | |
| 6,854,304 | B2 | 2/2005 | Linares | |
| 7,552,954 | B2 | 6/2009 | Rozo et al. | |
| 7,921,685 | B2 * | 4/2011 | Teskey | E05B 5/00 292/126 |
| 8,579,337 | B2 * | 11/2013 | Hidding | E05B 7/00 292/126 |
| 8,783,075 | B2 | 7/2014 | Matre | |
| 8,881,564 | B2 * | 11/2014 | Burns | E05B 85/14 292/35 |
| 9,284,748 | B2 * | 3/2016 | Le | E05B 41/00 |
| 9,482,029 | B2 * | 11/2016 | Le | E05B 41/00 |
| 2014/0210222 | A1 | 7/2014 | Weinerman et al. | |
| 2014/0373580 | A1 | 12/2014 | Le | |
| 2015/0376922 | A1 * | 12/2015 | Weinerman | E05C 3/24 70/344 |

* cited by examiner

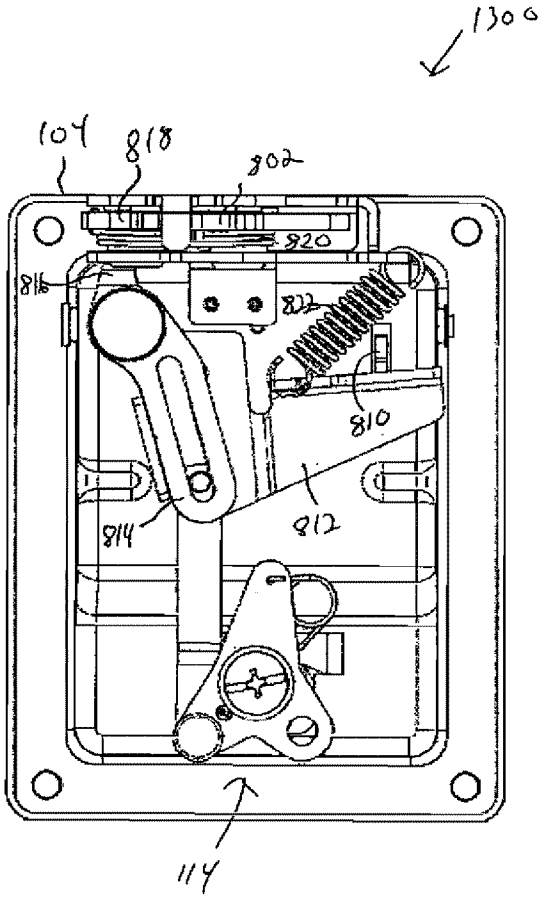
FIG. 13
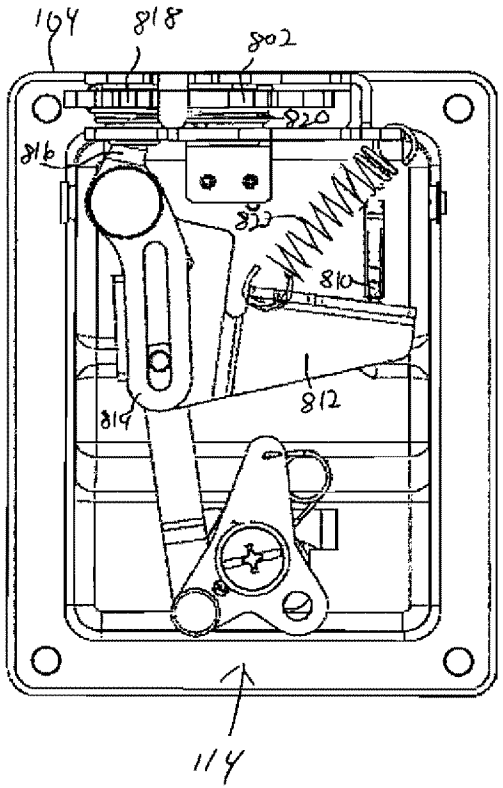
FIG. 14
FIG. 15

LATCH ASSEMBLY

CROSS REFERENCE TO RELATED APPLICATIONS

The application claims benefit pursuant to 35 U.S.C. §119(e) of provisional application 62/081,131 filed Jun. 27, 2014 the disclosure of which is incorporated herein by reference in its entirety.

BACKGROUND

Latch assemblies are mechanical apparatuses that are typically used to releasably hold/latch two elements in closed relation. For example, latch assemblies may be used to hold/latch a closure member such as a door or hatch in a closed position relative to an opening of a body member such as a door frame, hatch frame or other types of structures that bound an opening. Such latch assemblies are also operative to release/unlatch the closure member relative to the opening of a body member via mechanical manipulation of a portion of the latch assembly such as a movable handle. Latch assemblies may benefit from improvements.

SUMMARY

The following is a brief summary of subject matter that is described in greater detail herein. This summary is not intended to be limiting as to the scope of the claims.

In example embodiments, a latch assembly comprises a housing that includes a release mechanism in operative connection with a latch mechanism. The release mechanism may include a movable handle that is operable to move between a retracted position and an extended position relative to a receptacle in the housing.

When the latch assembly is not in a locked configuration, movement of the handle to the extended position is operative to cause the latch mechanism to change from a latched configuration to an unlatched configuration. While the latch mechanism is in the unlatched configuration, the release mechanism is configured to maintain the handle away from the retracted position (e.g., in a partially extended or fully extended position). However, when the latch mechanism operates to change from the unlatched configuration to the latched configuration, the latch mechanism is operative to enable the release mechanism to move the handle from an extended position to the retracted position relative to a receptacle in the housing.

Examples of latch assemblies that may be adapted to include latch and release mechanisms that cooperatively operate in this described manner may include paddle handle latches. An example of a paddle handle latch is shown in U.S. Pat. No. 6,513,353, which is incorporated by reference herein in its entirety. Another example of a paddle handle latch is shown in U.S. application Ser. No. 13/773,018 filed Feb. 21, 2013, which is incorporated by reference herein in its entirety.

Such paddle handle latches typically include a release mechanism that comprises a handle nested in a housing-defined receptacle. The handle is operable to pivot so as to move a linkage which is referred to herein as a trigger. Such a trigger may extend from the handle through an aperture in the base of the receptacle of the housing and engage with a further portion of the release mechanism mounted on a rear side of the housing. The latch mechanism may be operative responsive to the movement of the trigger to change to an unlatched configuration in which the latch mechanism is operative to unlatch a closure member (e.g., a door/hatch) with respect to a body member (e.g., a door/hatch frame).

For example, such a latch mechanism may include a rotary latch that is operative to engage with a striker of a closed door. Movement of the handle toward an extended position is operative to move the trigger so as to cause the latch mechanism to release the striker and permit the door to open. Also, while the latch mechanism is in this described unlatched configuration, the latch mechanism may cause the handle to be maintained in an intermediate position between the retracted position and the extended position.

Thus, if the door to which the described latch assembly is only partially closed in a manner in which the latch mechanism remains in the unlatched configuration, the extended orientation of the handle to the intermediate or other outward position may serve as a visual indicator that the door is not properly latched. Such a visual indicator may encourage a user of the latch assembly to try again to properly close the door so as to cause the latch mechanism to move to a latched configuration which holds the door in a closed position.

To further enhance the visual recognition of the extended handle, such a handle may include a distinctively colored surface that becomes visible when the handle is moved from the retracted position to the extended position. Such a distinctively colored surface may include colored labels mounted to side portions of the handle that extend outwardly from the cavity in the extended/intermediate positions of the handle and that are positioned in the cavity of the housing when the handle is in the retracted position. Distinctively colored labels, for example, may include labels having an orange or red coloring that is visually apparent in contrast to adjacent surfaces (such as the front surfaces) of the handle and housing of the latch assembly which have a different coloring.

For example, the handle and housing may be comprised of a stainless steel and may have a stainless steel metallic finish and the described colored labels may be mounted to portions of the stainless steel side walls of the handle. However, it should also be appreciated that the described latch assembly may be comprised of different metals and/or other materials which provide a different coloring for the front surfaces of the handle/housing compared to the sides of the handle. Also, the front surfaces of the handle/housing of the latch assembly may be coated with a paint or other coating that has a different color than the color of the adhesive labels or coatings applied to the sides of the handle.

To enable a latch assembly to operate in this described manner, an example embodiment may include a spring that is positioned to urge the handle to move from the retracted position toward the extended position. When the latch mechanism is in the unlatched configuration, the release mechanism becomes configured to enable the spring to maintain the handle in an intermediate position between the retracted position and the extended position. However, when the latch mechanism is in the latched configuration, the release mechanism moves the handle to the retracted position (overcoming the force of the spring), and thus prevents the spring from maintaining the handle in the intermediate position.

In an example embodiment, the release mechanism includes at least one lever that is operative to pivot with respect to the housing on the rear side of the housing. Movement of the handle from the retracted position toward the extended position causes the trigger to cause the at least one lever to rotate, which rotation causes the latch mechanism to change to an unlatched configuration.

In addition, when the latch mechanism is in the unlatched configuration, the latch mechanism is operative to prevent the at least one lever from rotating to a position that causes the trigger to move the handle to the retracted position. Thus, the previously described spring is operative to maintain the handle in the intermediate position.

In example embodiments that include a rotary latch mechanism, the latch mechanism may include both a rotary pawl and a rotary latch. The rotary pawl and rotary latch are respectively operable to rotate between respective first positions and second positions. In this example, the rotary latch includes a "U" shaped notch in an edge of the rotary latch that is operative to receive therein a striker that is operatively attached to a closure member. It should be appreciated that example embodiments may use either a single stage or a dual stage rotary latch mechanism.

When the latch mechanism is in the latched configuration, the rotary latch is in the first position in which an opening to the notch of the rotary latch is bounded by a wall of the latch mechanism such that the striker is prevented from moving out of the notch through the opening. Also, when the rotary pawl is in the first position, the rotary pawl is operative to prevent the rotary latch from rotating to the second position of the rotary latch.

In an example embodiment of the described latch assembly, the rotary pawl may be adapted to include first and second arms that bound opposed sides of a "U" shaped notch in an edge of the rotary pawl. The previously described at least one lever may include a projection that extends in the notch between the first and second arms. Responsive to the handle moving from the retracted position towards the extended position, the projection of the at least one lever rotates in contact with the first projection of the rotary pawl and causes the rotary pawl to move from the first position to the second position of the rotary pawl. The rotation of the rotary pawl in this manner enables the rotary latch (responsive to a spring) to rotate to the second position of the rotary latch to place the latch mechanism in the unlatched configuration.

When the latch mechanism is in the unlatched configuration, the rotary latch will be in the second position in which the opening to the notch of the rotary latch is not bounded by the wall of the latch mechanism and is operative to permit the striker to enter and exit the notch of the rotary latch through the opening. Also, the second arm of the rotary pawl is positioned to be operative to block the projection of the at least one lever from rotating to a position that causes the trigger to move the handle to the retracted position. Thus, as described previously, the spring associated with the handle is operative to maintain the handle in the intermediate position.

In an embodiment of the latch assembly that includes a lock mechanism, the described at least one lever may correspond to two levers such as an actuator lever and a disconnect lever. These two levers may be in pivoting connection with the housing. Of these two levers, the actuator lever includes the projection of the at least one lever. Also, of these two levers, the disconnect lever is operable to contact the trigger.

When the lock mechanism is in an unlocked configuration, the lock mechanism enables the actuator lever to rotate responsive to movement of the disconnect lever, such that movement of the trigger causes the projection on the actuator lever to urge the rotary pawl to rotate from the first position to the second position of the rotary pawl. As a result, movement of the handle causes the latch mechanism to change from a latched configuration to an unlatched configuration.

Also, when the lock mechanism is in the locked configuration while the latch mechanism is in the latched configuration, the handle may still be operative to move from the retracted position toward the extended position and cause the trigger to cause the disconnect lever to rotate. However, when the lock mechanism is in the locked configuration, the lock mechanism is operative to configure the release mechanism (via a movable lock/drive arm) so as to prevent the actuator lever from rotating responsive to rotation of the disconnect lever. As a result, movement of the handle does not cause the latch mechanism to change from a latched configuration to an unlatched configuration.

In an example embodiment, this described actuator lever may be adapted to include a flange or other structure that is operable to contact an edge of the disconnect lever. Thus, when the lock mechanism is in the locked configuration while the latch mechanism is in the unlatched configuration, the flange of the actuation lever is operable to prevent the disconnect lever from rotating to a position that causes the trigger to place the handle in the retracted position.

Also, it should be appreciated that example embodiments described herein may be used with other forms and styles of latch assemblies which include a handle or other type of user pulled release member that can be adapted to remain in an extended orientation until the latch mechanism changes to a latched configuration.

Other aspects will be appreciated upon reading and understanding the attached figures and description.

BRIEF DESCRIPTION OF THE DRAWINGS

FIGS. 13-15 are back views of the example latch assembly in different configurations.

DETAILED DESCRIPTION

Figure 1:
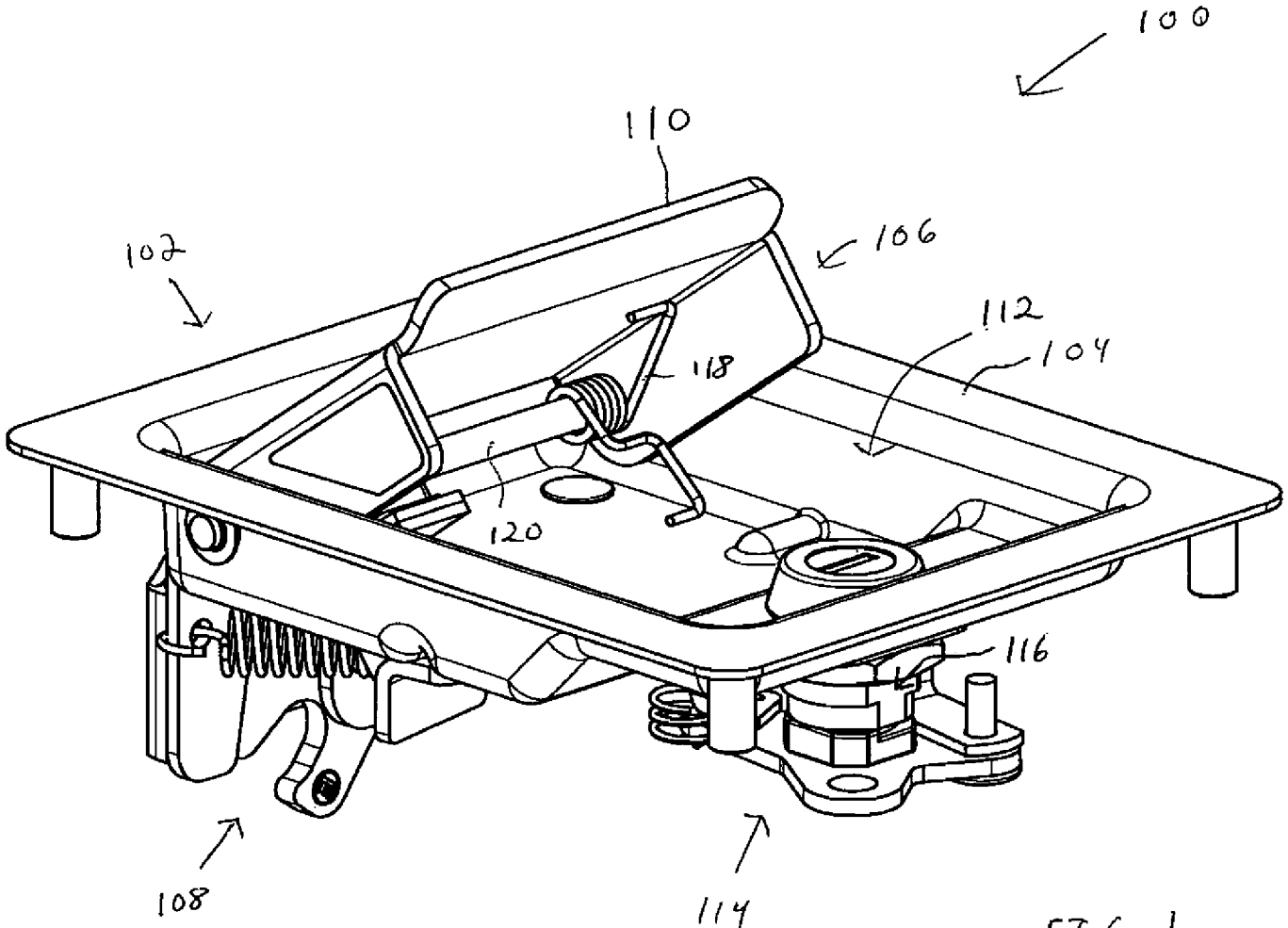
FIG. 1 is a front, bottom, left side perspective view of an example latch assembly.

Various arrangements pertaining to latch assemblies will now be described with reference to the drawings, where like reference numerals represent like elements throughout. Also, it is to be understood that functionality that is described as being carried out by certain components may be performed by multiple components. Similarly, multiple components that may be configured to perform the functionality that is described may have the functionality carried out by a single component.

With reference to FIG. 1, an example embodiment 100 of a latch assembly 102 is illustrated. The latch assembly includes a housing 104 to which is mounted a release mechanism 106 and a latch mechanism 108. The release mechanism 106 includes a pivoting handle 110 on a front side of the housing. The latch mechanism 108 is mounted on the rear side of the housing. Operation of the release mechanism is operative to cause the latch mechanism to operate. In this example the latch assembly 102 corresponds to a paddle handle latch. However, it should be noted that the features described herein for the latch assembly 102 may be used on other types of latch assemblies that include release mechanisms with user operated handles.

In an example embodiment, the housing 104 includes a receptacle 112. The handle 110 is operative to pivot between a retracted position and an extended position (shown in FIG. 1) relative to the receptacle. In the extended position, the handle extends relatively farther out of the receptacle than when in the retracted position.

Figure 5:
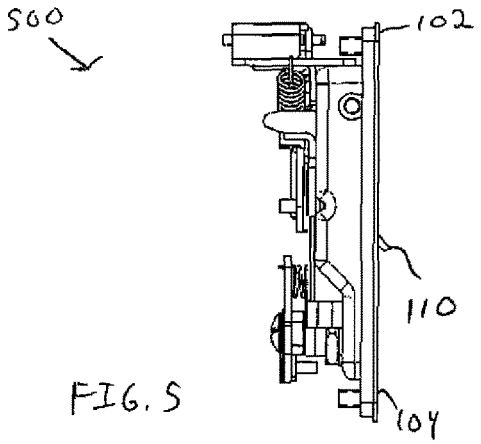
FIGS. 5-7 show side views of the latch assembly with the handle in different positions.
Figure 2:
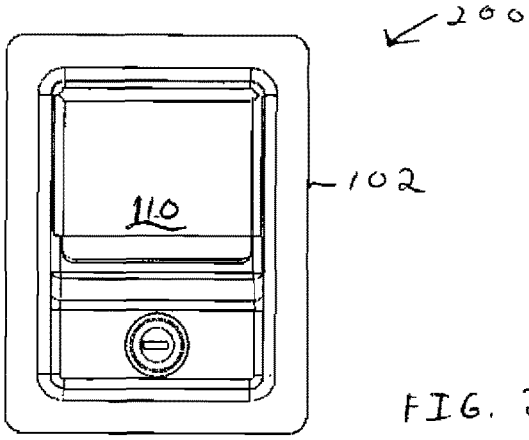
FIGS. 2-4 show front views of the latch assembly with a handle in different positions.
Figure 6:
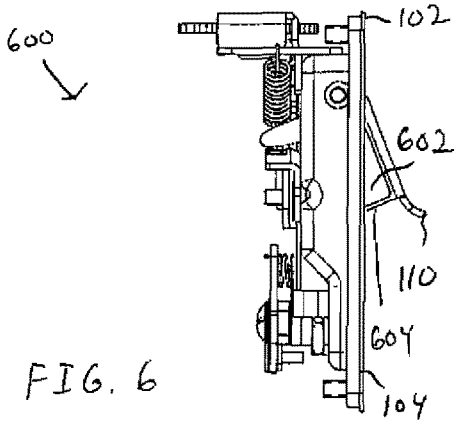
Figure 3:
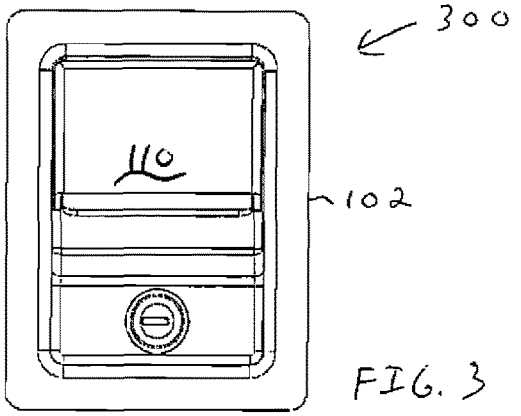
Figure 7:
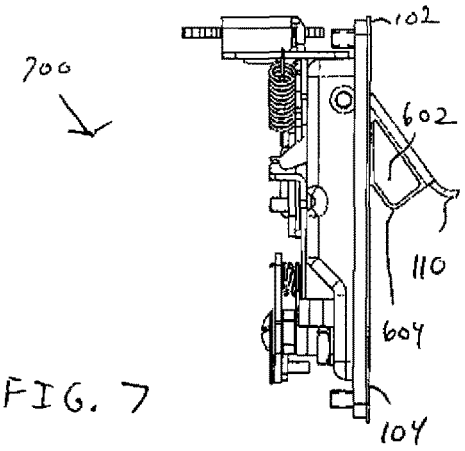
Figure 4:
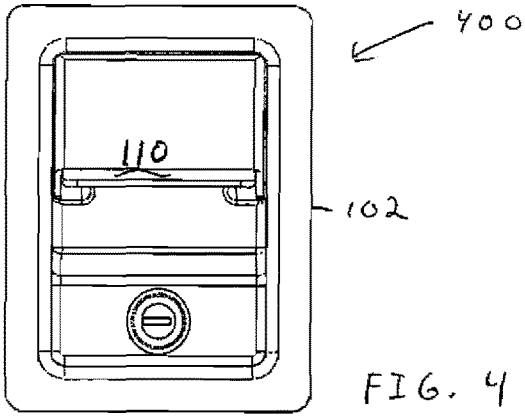

To further illustrate the operation of the handle, FIGS. 2, 3, and 4 show front views 200, 300, 400 of the latch assembly 102 with the handle 110 respectively shown in retracted, intermediate, and extended positions. Here the intermediate position of the handle corresponds to a partially extended orientation of the handle between the retracted and extended positions. Also, FIGS. 5, 6, and 7, show corresponding side views 500, 600, 700 of the latch assembly 102 with the handle respectively shown in the retracted, intermediate, and extended positions.

In an example embodiment, the latch mechanism may be operable to change between a latched condition and an unlatched condition responsive to the handle being moved from the retracted position toward the extended position. For example, starting from the latched condition, the latch mechanism 102 will have the configuration shown in FIGS. 2 and 5 with the handle 110 in a retracted position. To unlatch the latch mechanism, a user may pull on the handle which moves the handle 110 through the intermediate position shown in FIGS. 3 and 6 to an extended position shown in FIGS. 4 and 7. Then upon the user letting go of the handle 110, the latch mechanism is operative to automatically move the handle back to the intermediate position shown in FIGS. 3 and 6, where the handle is operative to remain until the latch mechanism is again placed in a latched condition. As will be explained in more detail below, in the exemplary arrangement the visual appearance of the handle in the intermediate position or an extended position serves as a visual indication that the handle is not in a latched condition.

Also, it should also be appreciated that in some embodiments, the described latch assembly may include a lock mechanism 114 that is configured to change between a locked condition and an unlocked condition. In the unlocked condition, the lock mechanism may be operative to permit movement of the handle 110 toward the extended position to cause the latch to change to an unlatched condition. However, when the lock mechanism is in the locked configuration, movement of handle to the extended position will not cause the latch mechanism to change to an unlatched configuration.

In the example shown in FIG. 1, the lock mechanism 114 includes a lock cylinder 116 that is operative to receive a key. Rotation of the key in the lock cylinder is operative to cause the lock to change between its locked and unlocked conditions. However, it should be appreciated that alternative embodiments may include different types of lock mechanisms mounted to the housing 104 and/or off of the housing (and connected via linkages/rods to the latch assembly). Also, it should be appreciated that in alternative embodiments, the latch assembly may not include or be connected to a lock mechanism. Also, it should be appreciated that in alternative arrangements of the example embodiments described herein, additional release mechanisms may be connected to the latch assembly via one or more linkages/rods in a manner that enables the additional release mechanisms to control the operation of the lock mechanism and/or the latch mechanism.

As shown in FIG. 1, example embodiments of the latch assembly 102 may include a spring 118 that is positioned to urge the handle 110 to move from the retracted position toward the extended position. Such a spring may correspond to a coil spring mounted around a shaft 120 about which the handle 110 is configured to pivot. Such a shaft may extend across the width of the receptacle and extend through apertures in the housing on opposed sides of the handle 110. However, it should be appreciated that in alternative embodiments the handle may be mounted in pivoting relation with the housing 104 in a manner that does not include a shaft extending across the receptacle 112 or in other configurations. In such alternative embodiments, one or more springs may be mounted to the housing and/or handle in a different configuration via one or more fasteners so as to be operative to urge the handle to move from the retracted position toward the extended position.

Figure 8:
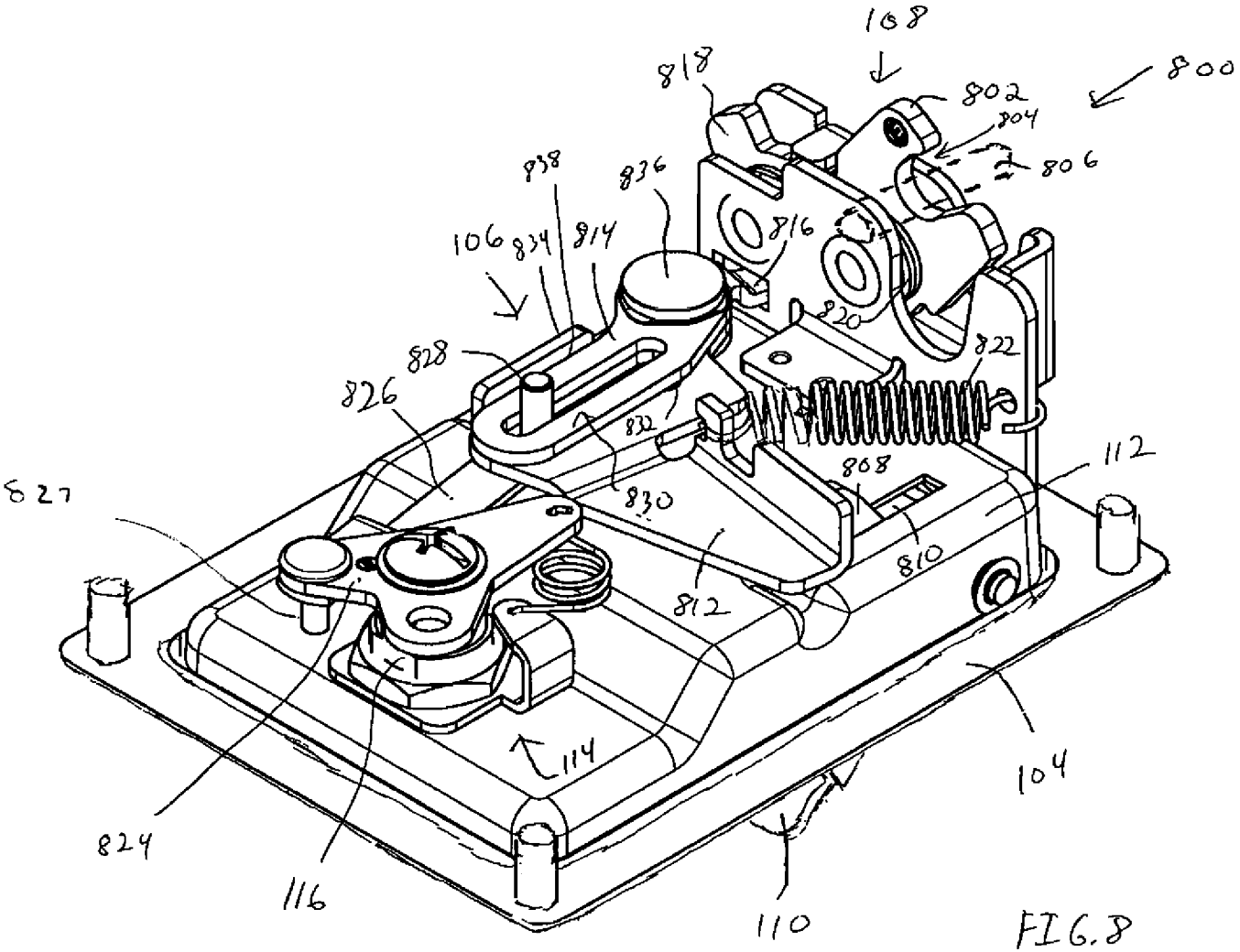
FIG. 8 is a rear, bottom, left side perspective view of the example latch assembly.

FIG. 8 is a perspective view 800 of a rear side of the housing 104. FIG. 8 and FIG. 1 show the latch assembly with the latch mechanism 108 in the unlatched configuration and with the release mechanism 106 in a release configuration. FIG. 1 shows the handle 110 in the extended position. Also, FIG. 8 and FIG. 1 show the lock mechanism 114 in an unlocked state.

In this described example embodiment, the latch mechanism 108 includes a latch member which is alternatively referred to as a rotary latch 802. Such a rotary latch 802 is operative to rotate clockwise and downwardly as shown in FIG. 8 to a latched positioned that is operative to hold a striker 806 (schematically shown in broken lines) in a channel, such as a "U" shaped notch 804 extending in a pair of disposed wall/plates 1002 of the rotary latch 802.

The described latch assembly may be configured such that when a lower portion of the handle 110 is manually lifted/pivoted (by a user) to the extended position, a trigger 808 connected to the handle 110 is operative to move in a manner that causes the latch mechanism 108 to unlatch an engaged striker 806. In the exemplary embodiment the trigger movement causes the rotary latch 802 to rotate counter-clockwise and upwardly to the position shown in FIG. 8.

The exemplary trigger extends through an aperture 810 through a wall of the receptacle 112 of the housing 104. The trigger operatively extends from the handle positioned on a front side of the housing and is engageable with further portions of the release mechanism 106 positioned on the rear side of the housing.

Figure 8A:
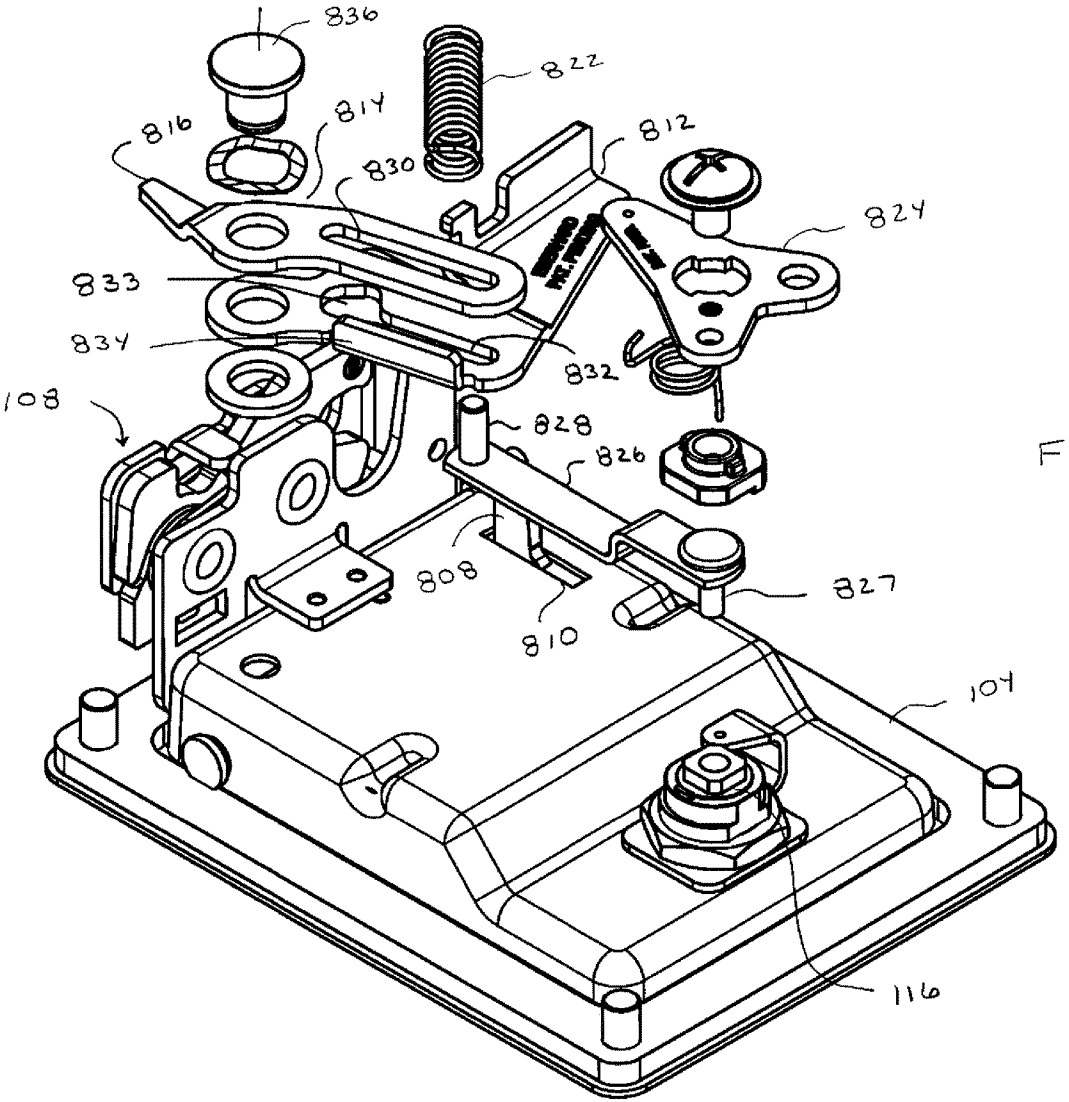
FIG. 8A is an exploded view corresponding to the main components shown in FIG. 8.

The further portions of the exemplary release mechanism 106 may include at least one linkage or lever in pivoting operatively supporting connection with the housing. For example, in this exemplary embodiment, the further portions of the release mechanism 106 include a first member, lever or linkage referred to herein as a disconnect lever 812, and a second member, lever or linkage 814 referred to herein as an actuation or actuator lever 814. In the exemplary arrangement these levers are in relative pivoting connection with the housing about a common pivot location 836. Positioned at such a pivot location 836 may be a shoulder rivet, bolt or shaft that extends through apertures in these levers and into operative engagement with the housing. As shown in FIG. 8A, suitable washers are positioned to facilitate rotation of the disconnect lever 812 and the actuator lever 814 about the common axis that extends through the fastener at the pivot location 836.

In the exemplary embodiment when the lock mechanism 104 is in an unlocked condition, the pivoting of the handle (from the retracted to the extended position) is operative to cause the trigger 808 to move downwardly on the back side of the housing. The trigger engages and causes the disconnect lever 812 to move/pivot in a direction that causes the actuator lever 814 to move/pivot in a direction that causes the latch mechanism 108 to change to its unlatched condition.

In this example, the exemplary actuation lever 814 includes a projection 816 that extends adjacent portions of the latch mechanism 108 such as a rotary pawl 818. As the actuation lever pivots (responsive to the handle), the projection 816 is positioned to urge the rotary pawl to move/rotate to a position that permits the rotary latch 802 to rotate so as to disengage an engaged striker. A spring 820 included in the latch mechanism 108 urges the rotary latch 802 to rotate to the unlatched configuration position shown in FIG. 8.

Also, as shown in FIG. 8, the exemplary release mechanism also includes a spring 822. This spring is operative to bias the disconnect lever 812 towards the trigger 808. Such an arrangement may operatively urge the trigger to move the handle toward its retracted position. However, in this exemplary embodiment, when the release mechanism is in the unlatched position shown in FIG. 8, the rotary pawl 818 is operative to prevent the spring 822 from causing the disconnect lever 812 from moving back to its initial position from the actuating position in which it changes the condition of the latch. The inability of the disconnect lever to return to the initial position prevents the trigger and the attached handle from moving all the way to the retracted position of the handle. Rather, the exemplary configuration of the exemplary rotary pawl 818 is operative when the latch is in the unlatched configuration, to limit the movement of the handle 110 in response to spring 822 to only the intermediate position shown in FIGS. 6 and 3. Also, it should be appreciated that in this exemplary arrangement, the spring 118 associated with the handle (shown in FIG. 1) also urges the handle 110 to remain at the intermediate position so that it does not pivot back to the retracted position due to gravitational forces. It should be understood that while in the exemplary embodiment the handle is biased to an intermediate position, in alternative embodiments the handle may be biased to other positions, including without limitation the extended position.

Figure 9:
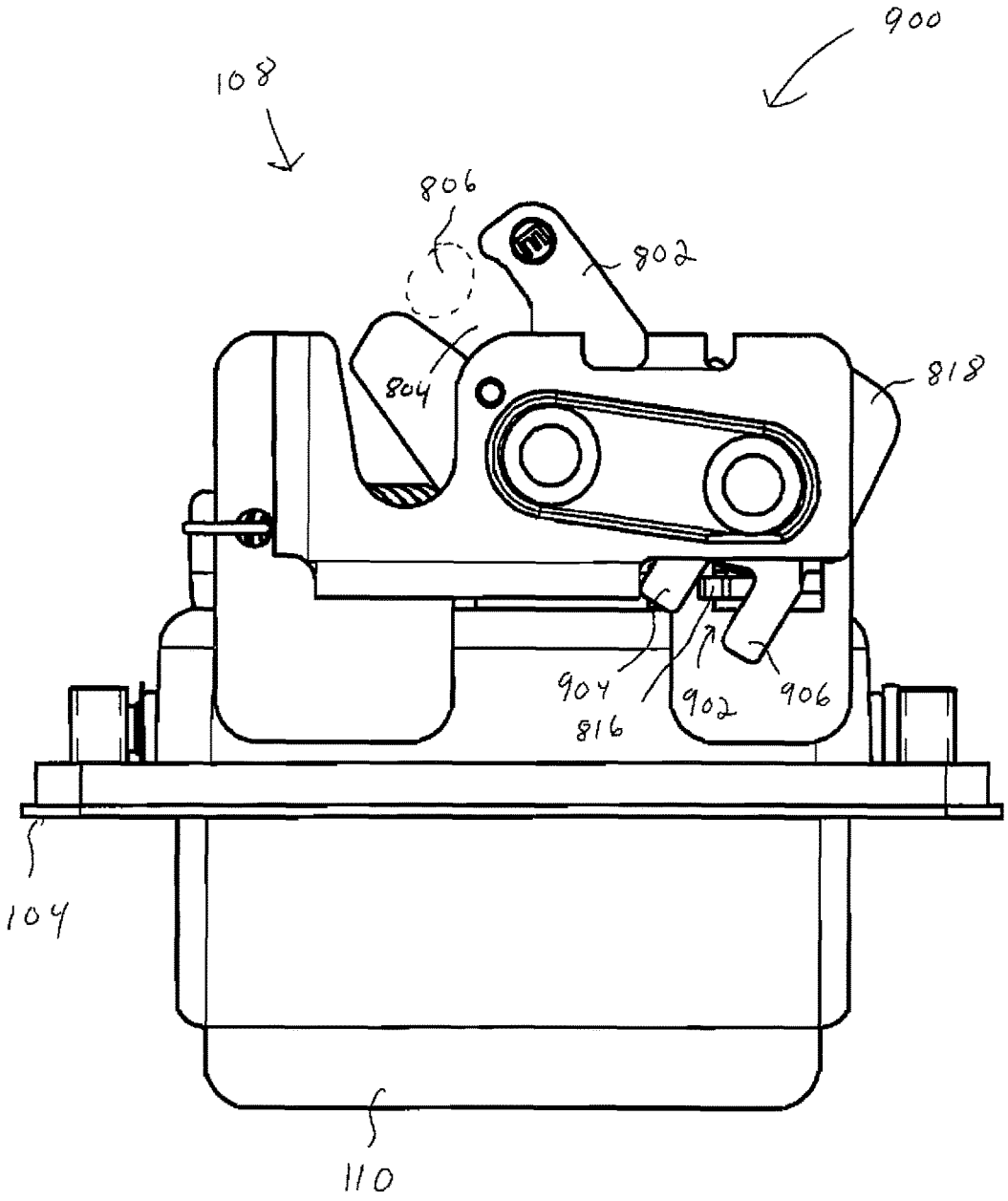
FIG. 9 is a top view of the example latch assembly.

FIG. 9 shows a top view 900 of the exemplary latch assembly 102 in order to more clearly show an example configuration of the latch mechanism 108 in the previously described unlatched condition. In this example, the rotary pawl 818 includes a recess or channel such as a "U" shaped notch 902 bounded by a first arm 904 and a second arm 906 which extend outwardly from the rotary pawl. The projection 816 of the actuation lever extends into the notch 902 between the first and second arms 904 and 906. Alternatively in other embodiments interengaging projections and recesses of other configurations may be used, and the positions of such features on the respective elements may be reversed or otherwise changed.

When the exemplary latch mechanism is in the unlatched condition, the features of the rotary pawl 818 that prevent the disconnect lever (shown in FIG. 8) from moving the trigger/handle to the retracted position include the configuration of the second arm 906. In the unlatched condition the second arm 906 engages and prevents the projection 816 from moving to the right as shown in FIG. 9. The arm 906 prevents the actuation lever and disconnect lever from rotating an amount necessary to cause the handle to be moved to the retracted position. Rather, the second arm 906 maintains the projection in a position that allows the handle to remain in the intermediate position.

Figure 10:
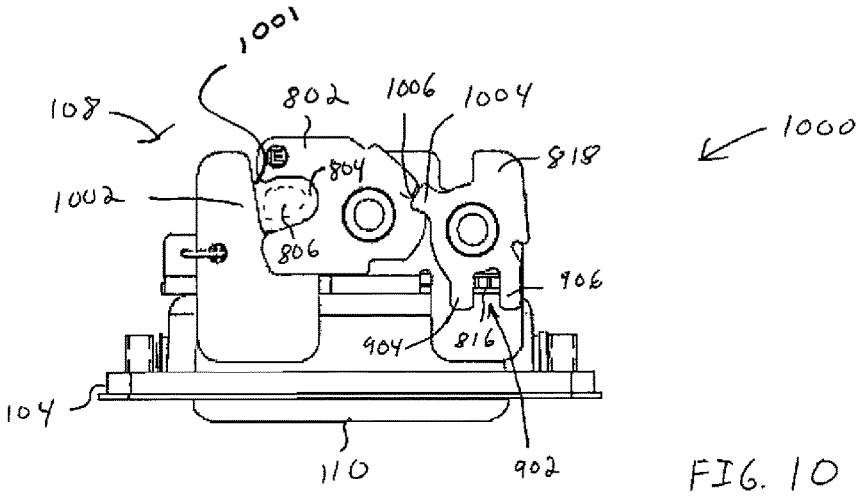
FIGS. 10-12 are inside views of different configurations of a latch mechanism of the example latch assembly in different configurations.
Figure 11:
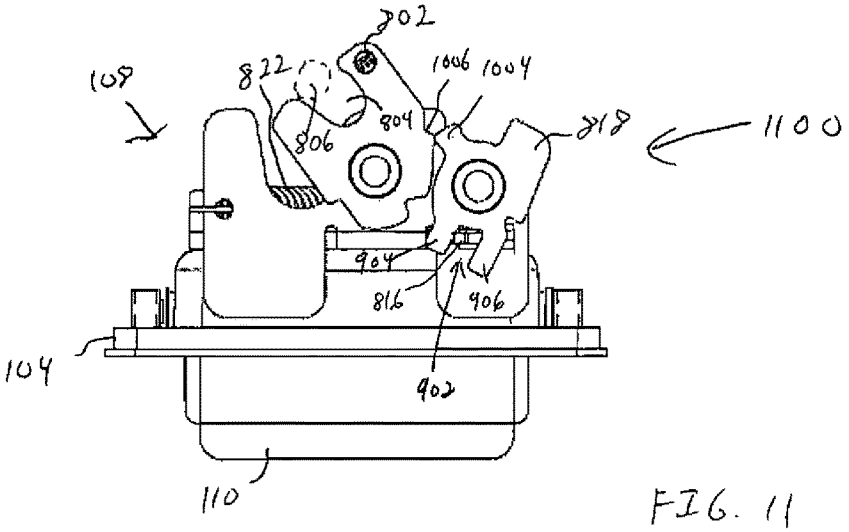
Figure 12:
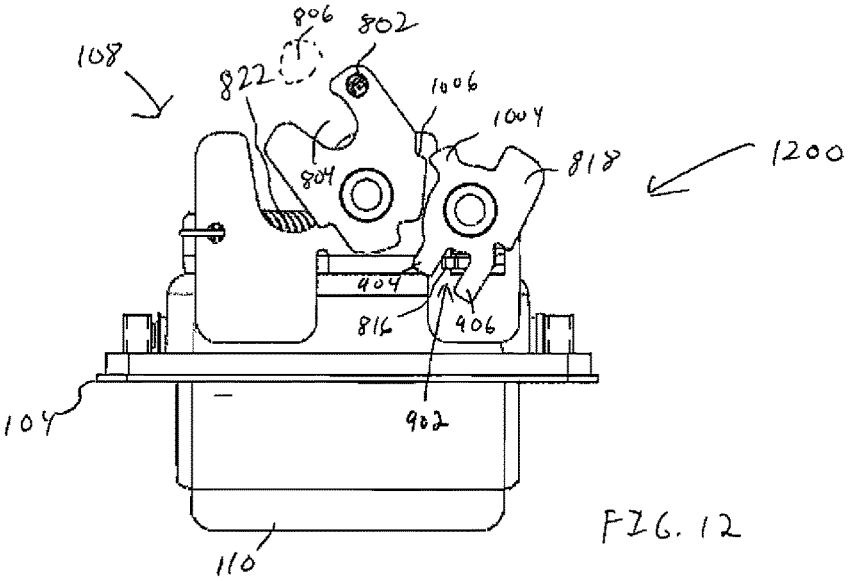

To show an example operation of the exemplary latch mechanism more clearly, FIGS. 10, 11, and 12 are internal top views 1000, 1100, 1200 of the latch assembly when the handle 110 is in the respective retracted, intermediate, and extended positions. These internal views show the rotary latch 802 and the release pawl 818 absent the outside cover of the latch mechanism. In FIG. 10, the latch mechanism 108 is shown in a latched condition. In FIGS. 11 and 12, the latch mechanism is shown in the unlatched condition.

Also, to show an example operation of the release mechanism on the rear side of the housing more clearly, FIGS. 13, 14, and 15 are back views 1300, 1400, 1500 of the latch assembly when the handle is in the respective retracted, intermediate, and extended positions.

Referring to FIG. 10, when the latch mechanism is in latched condition, the latch member 802 is rotationally positioned in a latched position such that the open end of the notch 804 is substantially bounded by surfaces 1001 on each wall/plate 1002 of the latch mechanism, only one of which is shown. Thus, in this position, a striker 806 is captured and remains engaged with the latch mechanism, and any door or hatch operatively connected to the striker is prevented from moving to an open position. In this latched configuration, a further projection 1004 on pawl 818 is operative to extend in and engage a further notch 1006 in the rotary latch. The engagement of the projection 1004 in the notch 1006 prevents the rotary latch from rotating responsive to forces acting through the striker (e.g., a user attempting to open a door attached to the striker). Also, in this latched configuration, the second arm 906 of the rotary pawl is in a rotational position that enables the projection 816 of the actuation lever 814 to be in a position that enables the release mechanism to urge the handle to the retracted position.

FIG. 13 shows the relative positions of the actuation lever 814, disconnect lever 812 and trigger 810 when the latch mechanism is in the latched configuration and the handle is in the retracted position. As shown in FIG. 13, the spring 822 biases the disconnect lever 812 so as to rotate upwardly and thereby push the trigger 810 upwardly, which places the handle in the retracted position.

When a user pulls the handle outwardly to its maximum extension with respect to the receptacle of the housing, the trigger moves downwardly through the position shown in FIG. 14 (e.g., the intermediate position of the handle) to the position shown in FIG. 15 (the extended position of the handle). This handle movement causes the trigger to push against the disconnect lever 812 causing it to pivot clockwise as shown from FIG. 13 to FIG. 15. Also, when the lock mechanism 114 is in the unlocked configuration shown in FIGS. 13-15, the clockwise movement of the disconnect lever is operative to move the actuation lever 814 in the clockwise direction as well. As a result, the projection 816 on the actuation lever rotates clockwise and urges the rotary pawl 818 to move from an engaged position in which the pawl holds the latch member in a latched position, to a release position in which the pawl releases the rotary latch 802 to move to an unlatched position.

For example, referring back to FIGS. 10-12, as the projection 816 moves in this described manner, the projection pushes the first arm 904 which causes the rotary pawl 818 to rotate clockwise from the engaged position shown in FIG. 10 through the release position shown in FIG. 11 and to the release position shown in FIG. 12. As the further projection 1004 of the rotary pawl rotates out of and disengages the further notch 1006 in the rotary latch, the latch member becomes free to move (responsive to a spring) so as to rotate clockwise from the latched position shown in FIG. 10, through the position shown in FIG. 11, to the unlatched position shown in FIG. 12.

When the user that is pulling on the handle lets go of the handle, the spring 822 (connected to the disconnect lever) is operative to cause the trigger to move upwardly at least a small amount. This movement of the trigger causes the disconnect lever, actuation lever, and rotary pawl to move counterclockwise at least a small amount to the positions shown in FIGS. 11 and 14 which corresponds to the intermediate position of the handle. However, further upwardly/counterclockwise movement of these elements is stopped at this position as a result of the further projection 1004 of the rotary pawl (shown in FIG. 11) contacting an edge bounding the rotary latch. This edge stops the rotary pawl from moving from the release position further counterclockwise back to the engaged position. As a result, the second arm 906 of the rotary pawl is operative to prevent further counterclockwise movement of the actuator lever and disconnect lever responsive to the biasing force of the spring 822.

Referring to FIG. 11, when a user closes a door/hatch that is operatively attached to the striker such that the striker 806 moves toward the latch mechanism, the force of the moving striker is operative to engage in the notch 804 and act on the rotary latch 802 and cause the rotary latch to rotate further counterclockwise as shown back to the position shown in FIG. 10. The rotation of the rotary latch to the latched condition places the further notch 1006 of the rotary latch in a position capable of receiving and engaging the further projection 1004 of the rotary pawl. Thus, with the rotary latch moving to this latched position, the rotary pawl rotates counterclockwise responsive to a spring (e.g., spring 822 and/or spring 820 shown in FIG. 8) from the release position to the engaged position so as to place the further projection in engagement with the further notch 1006.

In addition, as the rotary pawl rotates counterclockwise, the second arm 906 rotates counterclockwise to the position shown in FIG. 10. This enables the actuator lever, disconnect lever, trigger and handle to return to the positions shown in FIG. 10 and FIG. 13 (which correspond to the retracted position of the handle).

When the handle is in the extended position (see FIG. 7) or the intermediate position (see FIG. 6), the outwardly projecting/extending/angled orientation of the handle 110 relative to the housing 104 is of a sufficient degree to be visually apparent to a user of the latch assembly. In addition, to enhance the visual notification of the handle in the intermediate or extended positions, an example embodiment may further include at least one indicator surface on the handle that has a high visual contrast relative to other portions of the latch assembly such as the front facing surface of the handle and housing. For example, as shown in FIGS. 6 and 7, such an indicator surface may include adhesive labels 602 (having an orange, red, or other coloring or combination of colors). Such labels may be adhesively mounted to opposed side walls 604 of the handle 110 on opposed ends of the front facing surface of the handle.

As shown in FIG. 5, when the exemplary handle is in the retracted position with the latch mechanism in a latched configuration, such high contrast labels are not readily visible because they are disposed inside the walls bounding the receptacle of the housing. The inability to view such high contrast labels (especially from a sideways vantage point) may serve as a visual indicator that the door/hatch to which the latch assembly is mounted is closed and latched properly.

However in the exemplary arrangement, when the high contrast labels are visible by the handle sides extending out of the receptacle, such labels may serve as a visual indicator that the door or hatch is unlatched. Thus, for example, when the door to which the latch assembly is mounted appears closed but is not latched properly, the handle will be in the intermediate position shown in FIG. 6 and the visibility of the high contrast labels will serve as a warning that the door is not latched and needs to be properly closed.

In alternative embodiments, it should be appreciated that rather than labels, other types of high contrast elements may be applied to or integrated into the side walls 604 of the handle such as brightly colored paint, plastics, or any other material that forms a high contrast warning that the latch assembly is not yet latched. Alternatively other approaches to having an indicator that visibly shows that the latch assembly is not in the latched condition may be used. Such approaches may include for example other types of indicators on the handle sides or within the receptacle, for example.

In the configuration of the latch assembly shown in FIGS. 1-15, the lock mechanism 114 has been shown in an unlocked condition. As shown in FIG. 8, the example lock mechanism 114 may include a cam 824 that rotates with the rotation of a portion of the lock cylinder 116 that can be turned via a corresponding proper key. In addition, the exemplary lock mechanism includes a lock arm 826 in pivoting connection with the cam via a pin 827. An end of the lock arm disposed from the cam includes a movable member in the form of a pin 828 that extends in movable relation through slots 830, 832 in the actuator lever 814 and disconnect lever 812, respectively.

When the lock mechanism is in the unlocked condition, the pin 828 extends in a lower portion of the slots 830, 832 that is disposed away from the pivot location 836. The walls bounding the slots 830 and 832 are disposed apart somewhat further than the diameter of pin 828 such that the pin is movable relative to the slots. In the position of the pin shown in FIG. 8, the pin serves to operatively connect in engaged relation the disconnect lever 812 and the actuator lever 814 such that these levers rotate together in the clockwise direction. Thus, when the handle 110 is moved to the extended position, the actuator lever 814 rotates in a corresponding manner responsive to rotation of the disconnect lever 812.

Figure 16:
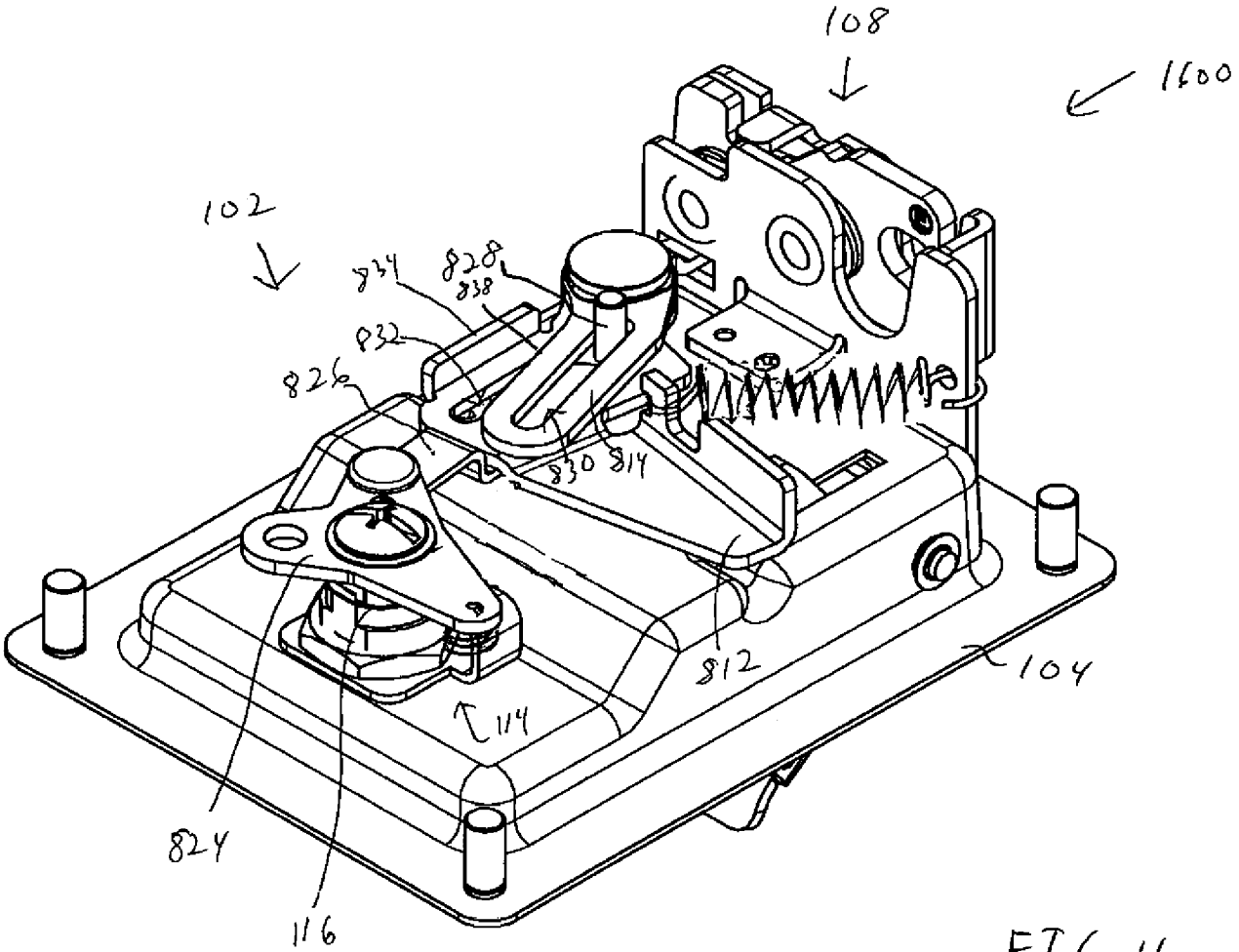
FIG. 16 is a rear, bottom, left side perspective view of the example latch assembly showing a lock mechanism in a locked configuration.

FIG. 16 is a perspective view 1600 of the rear of the exemplary latch assembly 102 when the lock mechanism is in a locked position. In this configuration, the rotation of the cam 824 has moved the lock arm 826 upwardly compared to the position shown in FIG. 8. In this configuration the pin 828 has moved to an upper portion of the slots 830, 832. As shown in FIG. 8A, the slot 832 in the disconnect lever includes a relatively wider upper portion 833 in proximity to the common pivot 836. For example, this wider upper portion 833 of the slot 832 of the disconnect lever extends outwardly beyond the wall bounding slot 830 of the actuator lever 814 and toward the side of the disconnect lever that engages the trigger 808.

The relatively wider upper portion 833 of the slot 832 enables the disconnect lever 812 to pivot counterclockwise without correspondingly moving the actuator lever 814. Thus, when the lock mechanism is selectively placed in the locked condition, the pin 828 is selectively positioned relative to both slots 830 and 832 so as to be closer to the pivot. In this position of the pin 828, the pin is aligned with the wider portion 823 of slot 832. With the pin 828 in this position, movement of the handle 110 (as shown in FIG. 16) to the extended position only causes the disconnect lever 812 to rotate counterclockwise as the walls bounding relatively wider upper portion 833 of the slot 832 does not engage the pin 828 and urge the pin to move. Because the pin 828 does not move when the disconnect lever moves, the actuation lever 814 also does not move. As a result, the projection 816 does not move the rotary pawl 818 and the latch mechanism 108 remains in the latched configuration. Thus, when the lock mechanism is in the locked condition, the handle may be moved back and forth between the retracted and extended position without causing the condition of latch mechanism to change to the unlatched condition.

As shown in FIGS. 8 and 16, it should be noted that the exemplary disconnect lever 812 includes a projection that is referred to as a flange 834. The flange 834 is operative to engage an edge 838 of the actuator lever 814. When the actuator lever is prevented from pivoting counterclockwise as a result of the latch mechanism being in the unlatched condition such as in FIG. 11, the edge of the actuator lever 814 contacts the flange 834 and prevents the flange and disconnect lever from rotating further counterclockwise responsive to the biasing force of spring 822. Thus, this described flange operates to prevent the disconnect lever from rotating counterclockwise. As a result the flange operates to transmit force and movement in one direction but not in the opposed direction. This avoids the need to rely on the pin 828 alone to carry out this function. As a result, fatigue and potentially eventual shearing of the pin that might otherwise occur is avoided.

It should be further noted that if the locking mechanism is placed in a locked condition (with the pin in the upper portions of the slots 830, 832) while the latch mechanism remains in the unlatched configuration shown in FIG. 8, the flange 834 is also operative to maintain the disconnect lever 812 in a position that maintains the handle in the intermediate position. Further, in this intermediate position, pushing the handle to the retracted position or pulling the handle to the extended position will not place additional stress on the mechanism components or change the positions of components of the latch mechanism 108.

Figure 18:
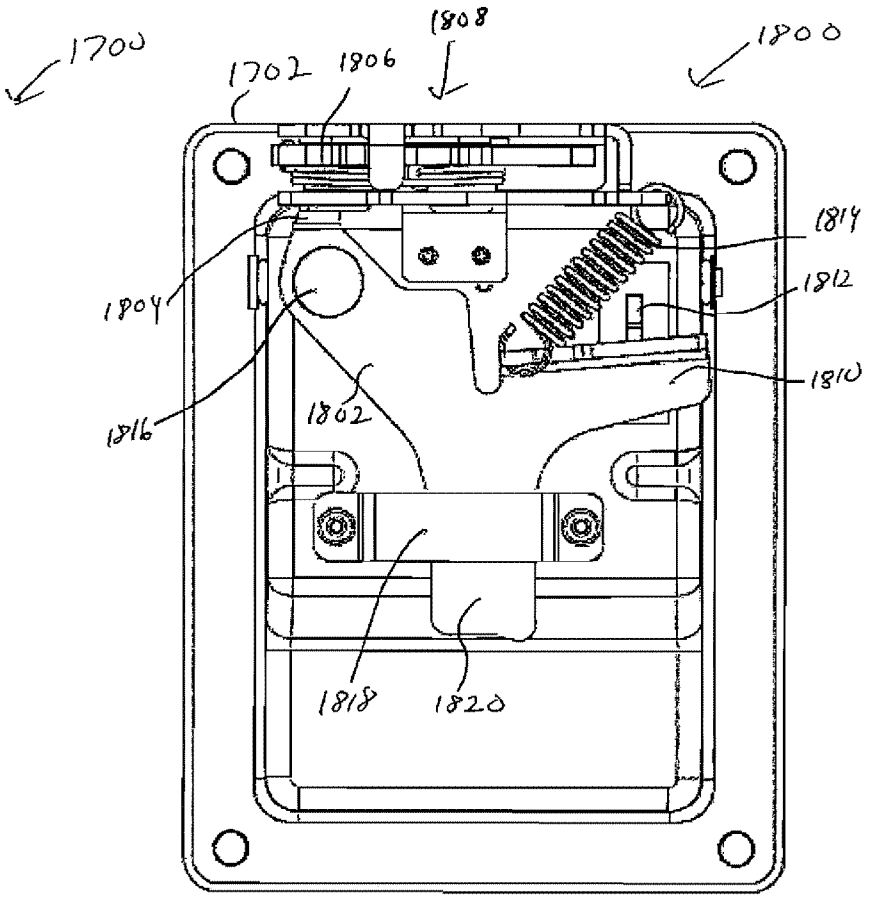
FIG. 18 is a rear view of the alternative latch assembly without a lock mechanism.
Figure 17:
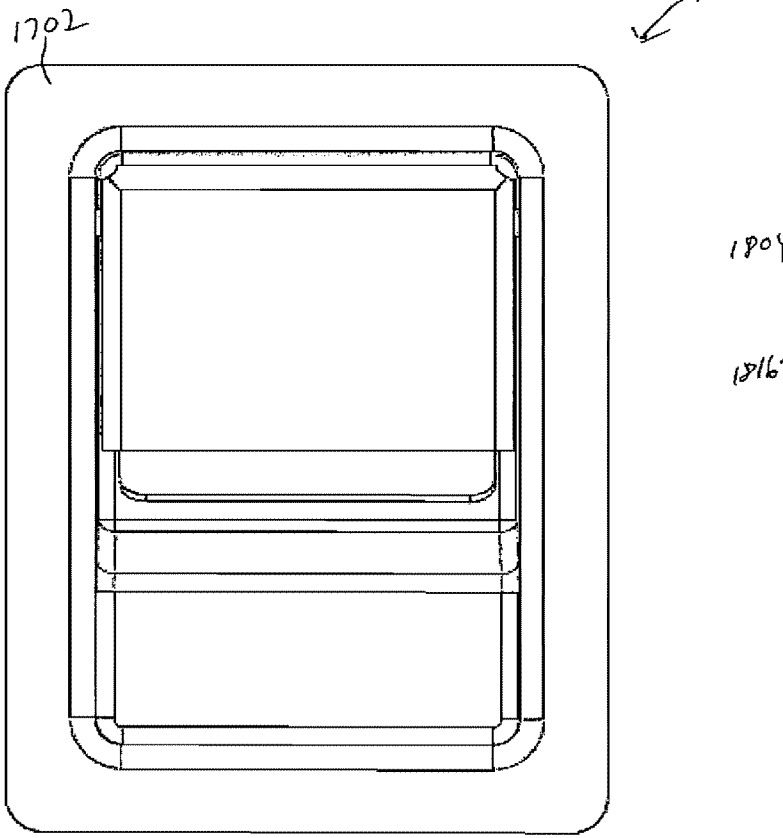
FIG. 17 is a front view of an alternative latch assembly without a lock mechanism.

It should be appreciated that some alternative embodiments of a latch assembly may not include a locking mechanism. As a result, the exemplary release mechanism described previously may have a different configuration compared to that shown in FIGS. 1-16. For example, FIG. 17 is a front view 1700 and FIG. 18 is a back view 1800 of an alternative embodiment of a latch assembly 1702 that does not include a lock mechanism. As shown in FIG. 18, rather than having separate actuation and disconnect levers as described in previous embodiments, the example latch assembly 1702 includes one lever 1802 with features from these previously described actuation and disconnect levers. Such a lever 1802 includes a projection 1804 that engages with the rotary pawl 1806 of a latch mechanism 1808 such as described in prior example embodiments. As is the case with levers 812 and 814 of the prior embodiments, lever 1802 rotates and moves in a plane.

In addition, in this exemplary embodiment the lever 1802 includes an end 1810 that is operative to engage and be moved by a trigger 1812 like that described in prior example embodiments. Also, the latch assembly 1702 includes a spring 1814 that is operative to urge the lever to rotate the first end 1810 towards the trigger 1812. The exemplary a lever 1802 is in pivoting connection with the housing of the latch assembly via a fastener such as a shoulder rivet or bolt 1816 mounted through an aperture in the lever to the housing of the latch assembly. In addition, to further support the lever and prevent the lever from twisting, the exemplary latch assembly includes a support bracket 1818 that extends across a body portion 1820 of the lever. The bracket and body portion serve as an interengaging guide and guide slot that guide the lever to move in its plane of movement and prevent movement transverse to the plane.

Figure 19:
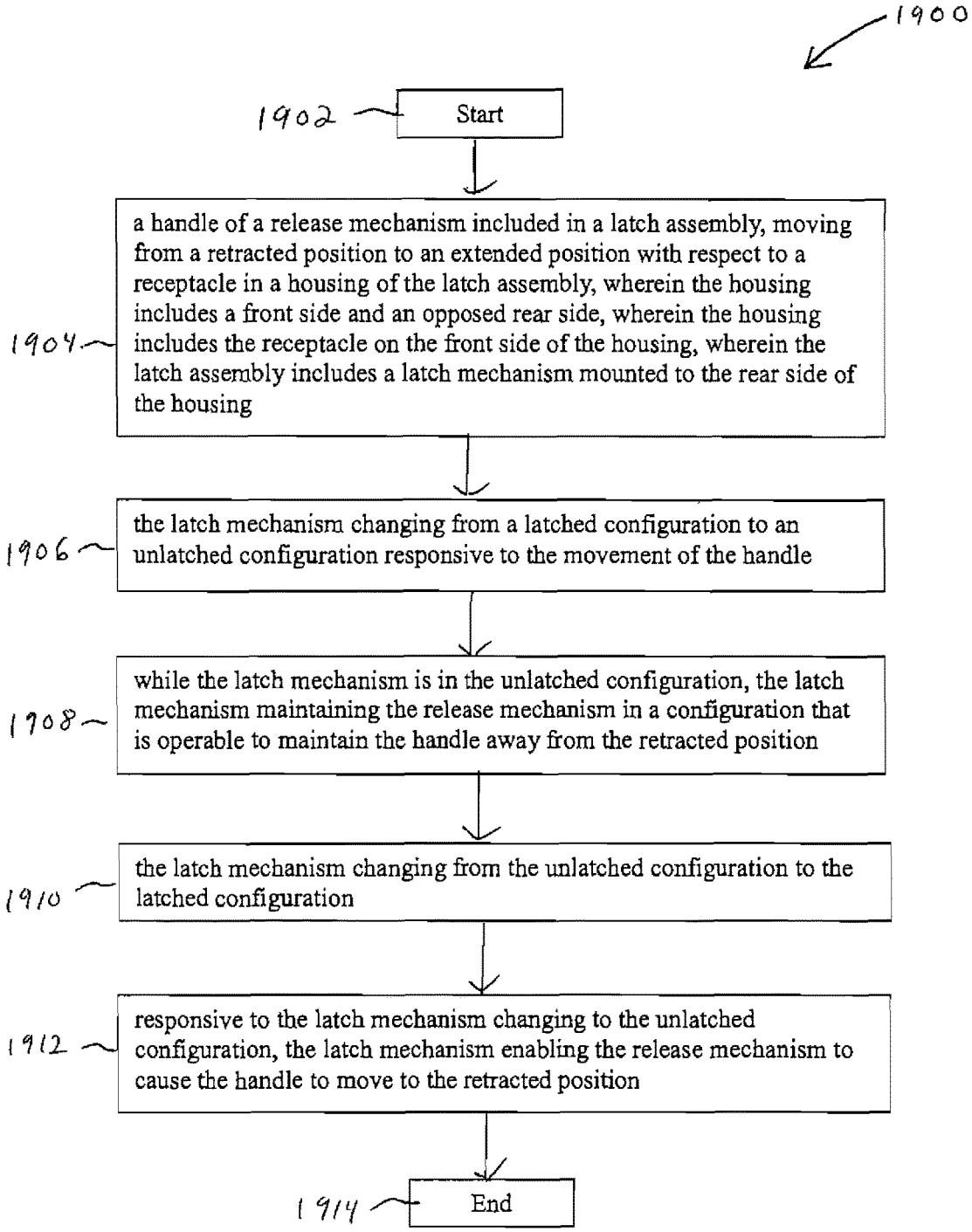
FIG. 19 is flow diagram that illustrates an example methodology for operating the latch assembly.

With reference now to FIG. 19, an example methodology is illustrated and described. While the methodologies are described as being a series of acts that are performed in a sequence, it is to be understood that the methodologies are not limited by the order of the sequence. For instance, some acts may occur in a different order than what is described herein. In addition, an act may occur concurrently with another act. Furthermore, in some instances, not all acts may be required to implement a methodology described herein.

Referring now to FIG. 19, a methodology 1900 that facilitates operating the previously described latch apparatus is illustrated. The methodology 1900 begins at 1902, and at 1904 includes a handle of a release mechanism included in a latch assembly, moving from a retracted position to an extended position with respect to a receptacle in a housing of the latch assembly. As discussed previously, the housing may include a front side and an opposed rear side. Also, the housing may include the receptacle on the front side of the housing. In addition, the latch assembly may include a latch mechanism mounted to the rear side of the housing.

The methodology may also include a step 1906 in which the latch mechanism changes from a latched condition to an unlatched condition responsive to the handle moving in step 1904. At step 1908, while the latch mechanism is in the unlatched condition, the latch mechanism maintains the release mechanism in a configuration that is operable to maintain the handle away from the retracted position.

In addition, at step 1910, the exemplary latch mechanism changes from the unlatched configuration to the latched configuration, and at step 1912, responsive to changing to the latched configuration in step 1910, the latch mechanism enables the release mechanism to cause the handle to move to the retracted position. At step 1914 the methodology ends.

It should also be noted that this example methodology may include one or more of the functions and features of the latch assemblies described previously. For example, the methodology may include additional steps associated with a lock assembly changing between an unlocked and a locked configuration.

It is noted that several examples have been provided for purposes of explanation. These examples are not to be construed as limiting the hereto-appended claims. Additionally, it may be recognized that the examples provided herein may be permutated while still falling under the scope of the claims.

Thus the exemplary embodiments described herein achieve improved operation, eliminate difficulties encountered in the use of prior devices, systems and methods and attain the useful results described herein.

In the foregoing description certain terms have been used for brevity, clarity and understanding. However, no unnecessary limitations are to be implied therefrom because such terms are used for descriptive purposes and are intended to be broadly construed. Moreover, the descriptions and illustrations herein are by way of examples and the inventive aspects are not limited to the features shown and described.

Having described the features, discoveries and principles of the exemplary embodiments, the manner in which they are constructed and operated and the advantages and useful results attained, the new and useful structures, devices, elements, arrangements, parts, combinations, systems, equipment, operations, methods, processes and relationships are set forth in the appended claims.

What is claimed is:

1. A latch apparatus comprising:

a housing, wherein the housing includes a front side and an opposed rear side, wherein the housing includes a receptacle on the front side of the housing, a release mechanism, wherein the release mechanism includes a handle, wherein at least a portion of the handle extends in the receptacle, wherein the handle is operative to move between a retracted position and an extended position with respect to the receptacle, a spring that is operable to urge the handle to move from the retracted position toward the extended position, a latch mechanism operatively attached to the rear side of the housing, wherein the latch mechanism is operative to change between a latched condition and an unlatched condition, wherein movement of the handle from the retracted position towards the extended position is operable to cause the release mechanism to cause the latch mechanism to change from the latched condition to the unlatched condition, wherein when the latch mechanism is in the unlatched condition, the release mechanism is configured to enable the spring to maintain the handle in an intermediate position intermediate of the retracted position and the extended position, wherein when the latch mechanism is changed from the unlatched condition to the latched condition, the latch mechanism is operable to enable the release mechanism to cause the handle to move to the retracted position, and the release mechanism is operable to prevent the spring from maintaining the handle in the intermediate position.

2. The latch apparatus according to claim 1, wherein the release mechanism includes at least one lever that is operative to pivot with respect to the housing, wherein the receptacle includes an aperture between the front and rear sides of the housing, wherein the release mechanism includes a trigger in operative connection with the handle, and at least a portion of the trigger extends through the aperture, wherein movement of the handle from the retracted position towards the extended position causes the trigger to cause the at least one lever to rotate, which rotation causes the latch mechanism to change from the latched condition to the unlatched condition, wherein when the latch mechanism is in the unlatched condition, the latch mechanism is operative to prevent the at least one lever from rotating to a position that causes the trigger to move the handle to the retracted position.

3. The latch apparatus according to claim 2, wherein the latch mechanism includes a rotary pawl and a rotary latch, wherein the rotary pawl and rotary latch are respectively operable to rotate between respective first positions and second positions, wherein the rotary pawl includes first and second arms that bound opposed sides of a pawl notch in the rotary pawl, wherein the at least one lever includes a projection that extends in the pawl notch between the first and second arms, wherein the rotary latch includes a latch notch that is configured to receive a striker, wherein when the latch mechanism is in the latched condition:

the rotary latch is in the first position of the latch in which an opening to the latch notch is adjacent to a wall of the latch mechanism such that the striker is prevented from moving out of the latch notch through the opening, the rotary pawl is in the first position of the pawl and is operative to prevent the rotary latch from rotating to the second position of the latch;

wherein responsive to the movement of handle from the retracted position towards the extended position, the projection of the at least one lever moves in engagement with the first arm bounding the pawl notch and causes the rotary pawl to move from the first position to the second position of the pawl, which enables the rotary latch to rotate to the second position of the latch to place the latch mechanism in the unlatched condition;

wherein when the latch mechanism is in the unlatched condition:

the rotary latch is in the second position of the latch in which the opening to the latch notch is not adjacent the wall of the latch mechanism and is operative to permit the striker to enter and exit the latch notch through the opening, the second arm bounding the pawl notch is operative to prevent the projection of the at least one lever from rotating to a position that causes the trigger to move the handle to the retracted position.

4. The latch apparatus according to claim 3, wherein the at least one lever includes an actuator lever and a disconnect lever in pivoting connection with the housing, wherein the latch assembly further includes a lock mechanism that is operative to change from an unlocked condition to a locked condition, wherein the actuator lever includes the projection, wherein the disconnect lever is operable to contact the trigger, wherein the disconnect lever includes a flange that is operable to contact an edge of the actuator lever, wherein when the lock mechanism in is an unlocked condition, the lock mechanism is operative to cause the actuator lever to rotate responsive to movement of the disconnect lever, such that movement of the trigger causes the projection on the actuator lever to urge the rotary pawl to rotate from the first position to the second position of the pawl, and thereby cause the latch mechanism to change from the latch condition to the unlatched condition.

5. The latch apparatus according to claim 4, wherein when the lock mechanism is in the locked condition while the latch mechanism is in the latched condition:

the handle is operative to move from the retracted position toward the extended position and cause the trigger to cause the disconnect lever to rotate; and the lock mechanism is operative to configure the release mechanism to prevent the actuator lever from rotating responsive to rotation of the disconnect lever.

6. The latch apparatus according to claim 5, wherein when the lock mechanism is in the locked condition while the latch mechanism is in the unlatched condition, the flange of the disconnect lever is operable to prevent the disconnect lever from rotating to a position that causes the trigger to move the handle in the retracted position.

7. A latch apparatus comprising:

a housing, wherein the housing includes a front side and an opposed rear side, wherein the housing includes a receptacle on the front side of the housing, a release mechanism, wherein the release mechanism includes a handle, wherein the handle includes a front surface that faces outwardly of the receptacle and at least one adhesive label disposed away from the front surface that includes at least one indicator surface portion that is a different color than the front surface of the handle, wherein at least a portion of the handle extends in the receptacle, wherein the handle is operative to move between a retracted position and an extended position with respect to the receptacle, a latch mechanism operatively attached to the rear side of the housing, wherein the latch mechanism is operative to change between a latched condition and an unlatched condition, wherein movement of the handle from the retracted position towards the extended position is operable to cause the release mechanism to cause the latch mechanism to change from the latched condition to the unlatched condition, wherein when the latch mechanism is in the unlatched condition, the latch mechanism is operable to maintain the release mechanism in a configuration that is operable to maintain the handle disposed away from the retracted position such that the at least one indicator surface portion extends out of the receptacle, wherein when the latch mechanism changes from an unlatched condition to the latched condition, the latch mechanism is operable to enable the release mechanism to cause the handle to move to the retracted position wherein the at least one indicator surface portion is located in the receptacle.

8. The latch apparatus according to claim 7, wherein the handle includes two opposed side ends on opposite sides of the front surface, wherein each of the two opposed sides includes an adhesive label thereon including a respective indicator surface portion, wherein the front surface does not include an adhesive label thereon, wherein the front surface includes a metallic finish.

9. A latch apparatus comprising:

a housing, a handle movably mounted in operative connection with the housing, wherein the handle is movable between a first position and a second position, a latch member movably mounted in operative connection with the housing, wherein the latch member is configured to releasably engage a striker, a pawl movably mounted in operative connection with the housing, wherein the pawl is movable between an engaged position in which the pawl is enabled to operatively hold the latch member in a latched position in which the latch member is enabled to hold the striker in engagement therewith, and a release position in which the pawl enables the latch member to move to an unlatched position in which the striker and the latch member may disengage, wherein the pawl is configured such that when the latch member is in the unlatched position, the pawl is unable to move from the release position to the engaged position, at least one lever movably mounted in operative connection with the housing, wherein the at least one lever is in operative connection with the handle, an interengaging projection and recess, wherein the at least one lever is in operative connection with one of the projection or recess and the pawl is in operative connection with the other of the projection or recess, at least one spring, wherein the at least one spring is in operative connection with the handle and is operative to bias the handle toward the second position, wherein in the latched position of the latch member and the pawl in the engaged position, movement of the handle from the first position to the second position is operative to cause the at least one lever to cause pawl movement to the release position such that the latch member is enabled to move to the unlatched position, and wherein with the latch member in the unlatched position the pawl is prevented from being moved from the release position to the engaged position and the handle is prevented from being held through operation of the latch in the first position.

10. The apparatus according to claim 9 wherein the at least one spring comprises a first spring and a second spring, wherein the first spring is in operative connection with the at least one lever and the handle, and is operative to bias the handle toward the first position, wherein the second spring is in operative connection with the handle, and the second spring is operative to bias the handle toward the second position, wherein with the pawl held in the release position the at least one lever is prevented from moving to cause the handle to be moved by operation of the first spring to the first position, and the second spring causes the handle to be moved away from the first position.

11. The apparatus according to claim 9 wherein the recess comprises a pawl notch bounded by two disposed arm portions, wherein the projection extends on the at least one lever and between the two disposed arm portions, wherein one of the arm portions is moved in engagement with the projection as the at least one lever moves from an initial position to an actuating position and the pawl is moved from the engaged position to the release position, and wherein the other of the arm portions prevents the at least one lever from returning to the initial position when the pawl is in the release position and the latch member is in the unlatched position.

12. The apparatus according to claim 9 wherein the handle is in operative connection with at least one visible indicator, wherein the at least one visible indicator is not visible externally of the housing when the handle is in the first position.

13. The apparatus according to claim 12 wherein the housing includes a recess, and wherein in the first position of the handle the at least one visible indicator is within the recess.

14. The apparatus according to claim 11 wherein the handle is in operative connection with the at least one lever during movement of the handle from the first position to the second position and the at least one lever is moved from the initial position to the actuating position, and wherein when the at least one lever is prevented from returning to the initial position through operation of the pawl, the handle is movable independent of the at least one lever.

15. The apparatus according to claim 9 wherein the at least one lever is configured to move generally within a plane, wherein the at least one lever is in operative connection with one of a guide projection or a guide slot and the housing is in operative connection with the other of the guide projection or the guide slot, wherein the guide projection is configured to move in engaged relation with the guide slot and to prevent the at least one lever from moving transversely to the plane.

16. The apparatus according to claim 9 wherein the at least one lever comprises a first lever and a second lever, wherein the first lever and the second lever are relatively movable with respect to one another, a movable member, wherein the movable member is selectively movable relative to both the first lever and the second lever, wherein movement of the movable member is operative to selectively engage and disengage the first and second levers, wherein when the first and second levers are engaged, the first and second levers are constrained to move together, and wherein when the first a second levers are disengaged, the first and second levers are independently movable, and wherein when the movable member causes the first and second members to be disengaged, movement of the handle does not cause the latch member to move from the latched position to the unlatched position.

17. The apparatus according to claim 16 wherein one of the first lever and the second lever include a flange, wherein the flange is operable to engagingly bias the other of the first and second levers in a first direction independent of the movable member, but not in an opposed direction.

18. The apparatus according to claim 9 wherein the housing comprises a recess, and wherein the handle is rotatably mounted in operative connection with the housing, and wherein in the first position, at least one portion of the handle extends within the recess and in the second position of the handle, the at least one portion of the handle extends outside the recess, and wherein the at least one portion of the handle includes a distinctive visual indicator that is visible with the handle positioned in other than the first position.

* * * * *